US006337964B2

(12) United States Patent
Inami et al.

(10) Patent No.: US 6,337,964 B2
(45) **Date of Patent: *Jan. 8, 2002**

(54) AGITATING MEMBER, DEVELOPING APPARATUS AND PROCESS CARTRIDGE

(75) Inventors: Satoru Inami; Junichi Kato; Masahiro Yoshida, all of Kashiwa; Yusuke Nakazono, Toride; Seiichi Shinohara, Abiko, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,357

(22) Filed: Feb. 4, 2000

(30) Foreign Application Priority Data

Feb. 9, 1999 (JP) ..... 11-031725

(51) Int. Cl.[7] ..... G03G 15/08
(52) U.S. Cl. ..... 399/254
(58) Field of Search ..... 399/254, 272, 399/281, 258, 263; 366/280, 343

(56) References Cited

U.S. PATENT DOCUMENTS 4,711,551 A * 12/1987 Fujio et al. ..... 399/63
5,475,471 A 12/1995 Kisu et al. ..... 355/219
5,539,502 A * 7/1996 Koshino et al. ..... 399/272
5,543,899 A 8/1996 Inami et al. ..... 355/219
5,572,301 A * 11/1996 Shiratori ..... 399/263 X
5,765,077 A 6/1998 Sakurai et al. ..... 399/176
5,790,927 A 8/1998 Ando et al. ..... 399/176
5,884,130 A * 3/1999 Tsutsumi et al. ..... 399/254

FOREIGN PATENT DOCUMENTS

JP 62-208076 * 9/1987
JP 1-4778 * 1/1989

* cited by examiner

*Primary Examiner*—Joan Pendegrass
(74) *Attorney, Agent, or Firm*—Fitzpatrick, Cella, Harper & Scinto

(57) ABSTRACT

An agitating member for agitating a developer includes a metal shaft, a plate member joined to the metal shaft, and a sheet member joined to the plate member, the sheet member being free to curve. A developing apparatus includes a developer bearing member bearing a developer thereon, a developer container containing the developer therein, and the above-described agitating member provided in the developer container for agitating the developer and supplying it to the developer bearing member. A process cartridge detachably attachable to the main body of an image forming apparatus, includes an electrophotographic photosensitive member and the above-described developing apparatus.

14 Claims, 11 Drawing Sheets

AGITATING MEMBER, DEVELOPING APPARATUS AND PROCESS CARTRIDGE

BACKGROUND OF THE INVENTION

1. Field of the Invention

This invention relates to a process cartridge and a developing apparatus mounted to an image forming apparatus of the electrophotographic type such as a copier, a page printer or a facsimile apparatus, and further to agitating means mounted to the process cartridge and the developing apparatus.

2. Related Background Art

An example of the developing apparatus is shown in FIG. 15 of the accompanying drawings.

This developing apparatus 105 is provided with a developer container 105*a* for effecting the storage and custody of a toner (developer) 106, and a developing roller 108 which is a developer bearing member. A developing blade 109, which is a developer regulating member, bears on the developing roller 108, and serves to regulate the amount of the toner 106 on the developing roller 108 and charge the toner 106.

Also, there are often provided agitating means 110 and 111 for loosening the toner 106 in the developer container 105*a* and feeding it to the developing roller 108 side. These agitating means 110 and 111 have the action of stabilizing the supply of the toner 106 to the developing roller 108 and creating the flow of the toner 106 in the directions of arrows P1 and P2 to thereby make the circulation of the toner great and moderate the deterioration of the toner 106.

By an engine controlling portion 107 provided with a power source for driving an image forming apparatus and a high voltage circuit for supplying a bias for effecting image formation, a developing bias, comprising an AC bias superimposed on a DC bias, is imparted between a photosensitive drum 101, which is an electrophotographic photosensitive member, and the developing roller 108, and the toner 106 is supplied from the developing apparatus 105 as described above, whereby a latent image, formed on the photosensitive drum 101, is developed.

Now, recently a resolution of 1200 dpi or 2400 dpi has been required and a high quality of image corresponding thereto has become necessary. As a means for achieving it, it has been found that a fine-grained toner is highly effective and preferable for bettering dot reproducibility. Further, it has been found that an average toner-grain diameter of 7 um or less leads to the capability of developing a latent image with high fidelity thereto.

Also, the coat amount of the toner in the developing area of the developing roller 108 is reduced, whereby the wasteful development by the toner can be suppressed and the scattering of the toner to the vicinity of the latent image can be decreased, and sharp characters and lines can be reproduced.

However, by the toner being fine-grained, the surface area per unit volume of toner becomes larger and therefore, the deterioration speed by the friction between toner grains becomes higher. Also, under a high-humidity environment, the humidity-absorbing amount of the toner tends to become greater, and the toner becomes liable to cohere.

Therefore, in a situation wherein the printing operation under a high-temperature, high-humidity environment is not being performed, the toner may sometimes absorb humidity and comes to cohere near the portion of contact between the developing roller 108 and the development blade 109. Thus, even when the printing operation is entered and the developing roller 108 is driven, the toner that has cohered does not immediately go to pieces. Therefore, the cost amount of the toner on the developing roller partly becomes small and the density sometimes becomes thin in the conveying direction. So, there has been desired agitating means that can obtain a sufficient agitating force even in a small space.

Also, by the coat amount of the toner on the developing roller 108 being reduced, the rate of the toner pushed aside by the developing blade 109 is increased and therefore, the deterioration by the friction or the like between toner grains becomes liable to be caused.

Further, in the above-described developing apparatus 5, it is difficult to utilize all of the toner 6 contained in the developer container 5*a* and accordingly, it is required that the toner be utilized without waste as far as possible.

SUMMARY OF THE INVENTION

It is a primary object of the present invention to provide an agitating member that can obtain a sufficient agitating force even in a small space.

It is another object of the present invention to provide agitating means and a developing apparatus that enable a toner contained in a developer container to be utilized without waste as far as possible.

It is another object of the present invention to provide a developing apparatus in which the deterioration of a toner can be prevented and even under a high-temperature, high-humidity environment, the scattering of the toner is small and a high quality of image can be obtained and further, uniform density can be obtained in an image area.

It is another object of the present invention to provide a process cartridge in which the deterioration of a toner can be prevented and even under a high-temperature, high-humidity environment, the scattering of the toner is small and a high quality of image can be obtained, and a stable density can be obtained during the service life of the cartridge, and to provide an electrophotographic image forming apparatus provided with such a process cartridge.

It is another object of the present invention to provide an agitating member for agitating a developer comprising:

- a metal shaft;
- a plate member joined to the metal shaft; and
- a sheet member joined to the plate member, the sheet member being free to curve.

It is still another object of the present invention to provide a developing apparatus comprising:

- a developer bearing member bearing a developer thereon;
- a developer container containing the developer therein; and
- an agitating member provided in the developer container for agitating the developer while supplying the developer to the developer bearing member, the agitating member including:
  - a metal shaft;
  - a plate member joined to the metal shaft; and
  - a sheet member joined to the plate member, the sheet member being free to curve.

It is yet still another object of the present invention to provide a developing apparatus comprising:

- a developer bearing member bearing a developer thereon;
- a developer container containing the developer therein, the developer being a monocomponent developer of which the weight average grain diameter is 7 $\mu$m or less; and an agitating member provided in the developer container for agitating the developer while supplying the developer to the developer bearing member, the agitating member including:

a straight metal shaft;

an L-shaped metallic plate member joined to the metal shaft, an end of the plate member being incapable of contacting an end of the developer container;

a sheet member joined to the plate member, the sheet member being free to curve, and an end of the sheet member being capable of contacting a bottom portion of the developer container;

another agitating member, the agitation loci of the agitating member and the another agitating member overlapping each other in a vertical direction, a diameter of the agitation locus of the another agitating member being larger than a diameter of the agitation locus of an agitating member, the agitation center of the another agitating member lying above an agitation center of the agitating member, the diameter of the agitation locus of the another agitating member being 30 mm to 50 mm, a peripheral speed of the another agitating member and a peripheral speed of the agitating member having differences relative to the developer bearing member, the peripheral speeds of the another agitating member and the agitating member differing from each other; and a developer regulating member for regulating the developer borne on the developer bearing member, the amount of applied developer regulated by the developer regulating member being 1.5 mg/cm$^2$ or less.

Other objects and features of the present invention will become more fully apparent from the following detailed description when read with reference to the accompanying drawings.

DETAILED DESCRIPTION OF THE PREFERRED EMBODIMENTS

Agitating means, a developing apparatus, a process cartridge and an electrophotographic image forming apparatus according to the present invention will hereinafter be described in greater detail with reference to the drawings.

[First Embodiment]

An embodiment of the developing apparatus constructed in accordance with the present invention will first be described with reference to FIG. 1.

Figure 1:
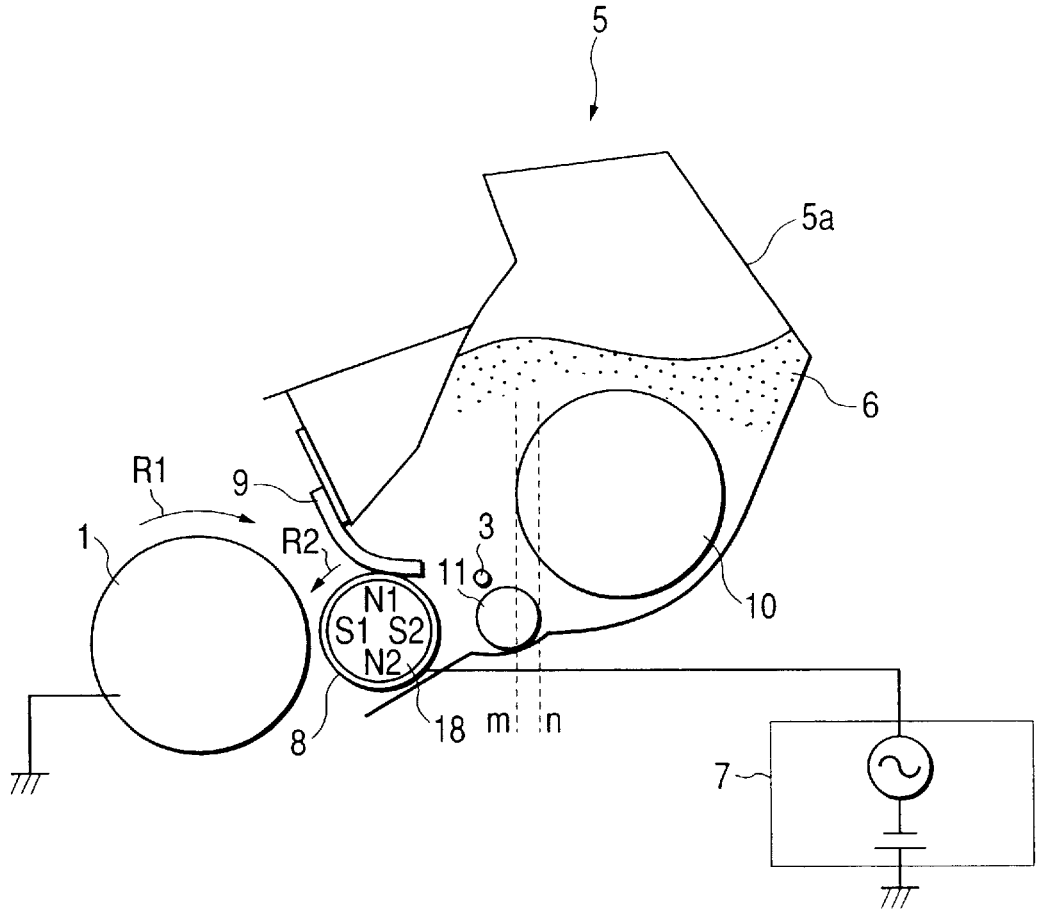
FIG. 1 schematically shows the construction of a developing apparatus according to a first embodiment of the present invention.

The developing apparatus 5 according to the present embodiment has a developer container 5*a* storing a toner (developer) 6 therein at the right in FIG. 1, and in the developer container 5*a*, there are installed first and second agitating means 10 and 11 for carrying the toner 6 to a developing roller 8 as a developer bearing member opposed to a photosensitive drum 1, which is an electrophotographic photosensitive member laterally provided in an opening portion formed at the left of the developer container 5*a* and rotated in the direction of arrow R1.

Also, a developing blade 9, as a developer regulating member for regulating the amount of the toner 6 borne on the developing roller 8, bears on the developing roller 8 in a direction counter to the rotating direction R2 of the developing roller 8.

The first agitating means (agitating means) 10 is disposed in the substantially central portion of the developer container 5*a* and acts to greatly circulate chiefly the toner 6 in the developer container 5*a*. Therefore the outer diameter of the first agitating means 10 is set to a rather large diameter of 30 to 50 mm.

The second agitating means (another agitating means) 11 is disposed between the first agitating means 10 and the developing roller 8, and acts to loosen the toner 6 and feed the toner to the developing roller 8 side. Particularly, it acts to moderately blend the fresh toner 6 fed from the first agitating means 10 and part of the toner 6 adhering to the developing roller 8 and pushed aside by the developing blade 9, and prevent the localized deterioration of the toner 6.

The first and second agitating means 10 and 11 are disposed so that the agitation locus of the first agitating means 10 and the agitation locus of the second agitating means 11 may overlap each other in a vertical direction when the developing apparatus 5 is mounted to the main body of the image forming apparatus. In FIG. 1, the portion between a broken line m and a broken line n is an area in which the two agitation loci overlap each other.

By the two agitation loci overlapping each other as described above, the toner can be agitated by the second agitating means 11 and fed to the developing roller 8 without the flow of the toner fed by the first agitating means 10 being stopped, whereby the smooth flow of the toner 6 can be created.

By the first and second agitating means 10 and 11 being disposed as described above, the force with which the toner 6 is fed to the developing roller 8 becomes great and the movement of the toner 6 pushed aside and discharged by the developing blade 9 becomes good and as the result, the circulation of the toner 6 in the developing apparatus 5 becomes good, and the deterioration of the toner 6 can be modified (alleviated).

Figure 2:
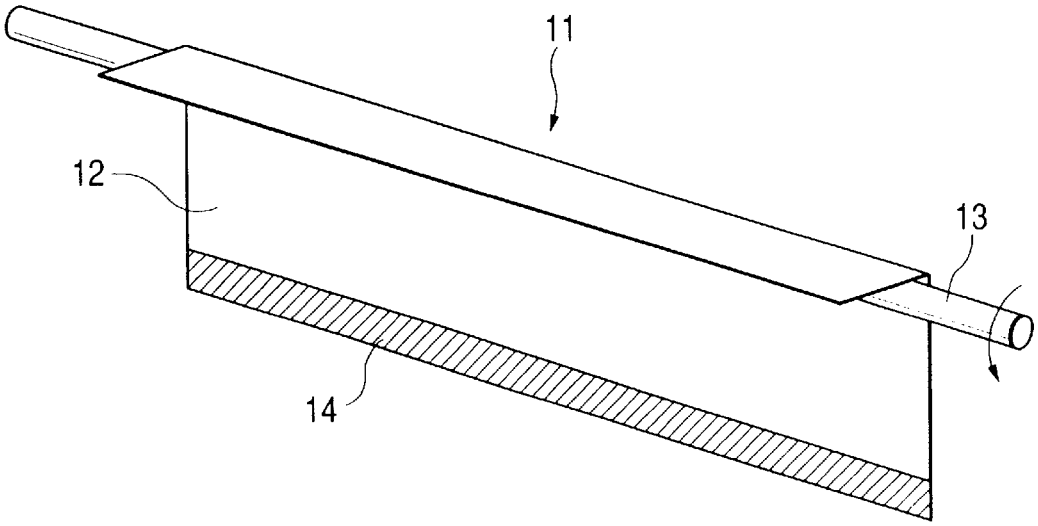
FIG. 2 is a perspective view showing second agitating means in the first embodiment.

The second agitating means 11, as shown in FIG. 2, is of a construction in which an L-shaped metal plate 12 is welded to a straight metal rod 13, which is a support shaft, and a sheet member 14 is stuck on the back of the metal plate 12 in the form of a band along the end portion thereof by a both-surface tape or the like.

Figure 3A:
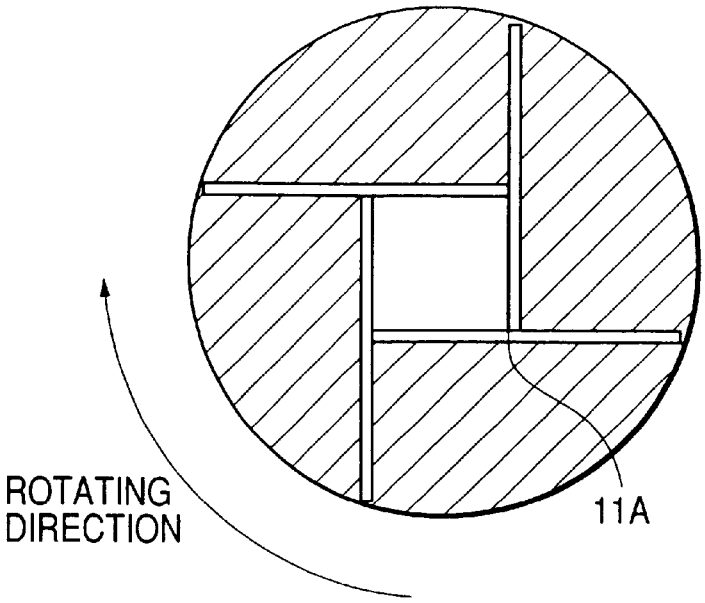
FIG. 3A PRIOR ART
FIGS. 3A and 3B are cross-sectional views showing agitating means according to the prior art and the second agitating means in the first embodiment, respectively.
Figure 3B:
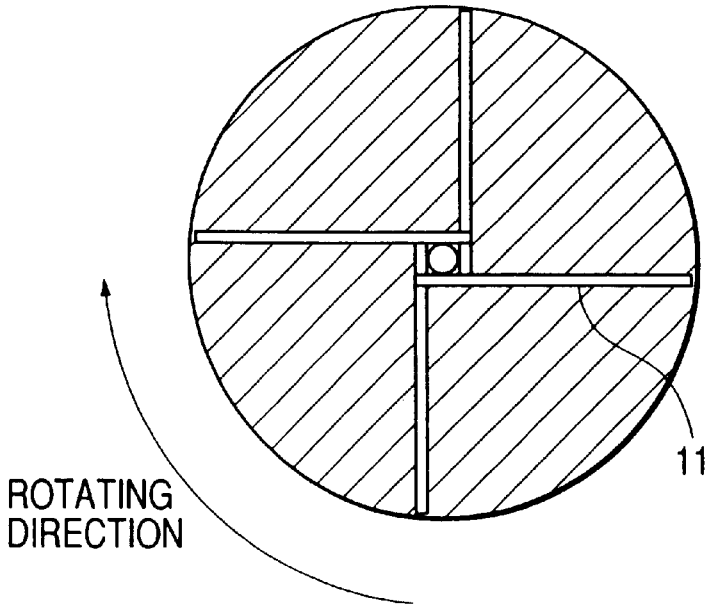

As an example of agitating means 11A according to the prior art using a vane member, in the case of agitating means in which a sheet member is adhesively secured to a square bar whose support shaft is made of resin, the support shaft must be given rigidity and a thickness to secure an overlap width for sticking the sheet member thereon. FIG. 3A shows the position of the sheet member at each 90° when the agitating means in that case is rotatively driven, the locus of the outermost diameter when the agitating means is rotated, and then the area in which the toner can be agitated. FIG. 3B shows the case of the agitating means 11 according to the present embodiment.

When the areas of the hatched portions in FIGS. 3A and 3B are compared with each other, it is seen that the hatched portion in FIG. 3B is wider than that in FIG. 3A. That is, the agitating means 11 according to the present embodiment is wider in the area wherein the toner is agitated and therefore, is greater in the amount of the toner fed.

As described above, the agitating means according to the present embodiment are characterized by a construction comprising a combination of a support shaft having a small diameter, a metal plate which is thin but durable in rigidity, and a sheet member. Particularly, in the second agitating means 11 located near the developing roller 8, compact agitation becomes necessary in a small space and therefore, the effect of the agitating means 11 of a construction like that of the present embodiment is great.

That is, the agitating force is present even in a small space and the fluidity of the toner near the developing roller can be increased and therefore, the localized deterioration of the toner can be prevented and the low density liable to occur under a high-temperature, high-humidity environment can be prevented.

The reason why the sheet member 14 is directly attached to the metal rod 13 is that there is the problem that during agitation, the sheet member 14 becomes curved and the agitating force is reduced. Thus, by using the L-shaped metal plate 12, the agitating force can be stabilized and the overlap width for the sticking of the sheet member 14 can be made great.

By the metal plate 12 being L-shaped, the metal rod 13 can be set on and fixed to the L-shaped portion when the metal plate 12 is to be fixed to the metal rod 13 and therefore, the agitating means can be stably assembled and the dimensional accuracy thereof becomes high and the rigidity thereof is increased. The metal plate 12 is made of SUS or the like, and the width of this plate must be such a dimension that when agitating, the plate does not touch the bottom of the developer container 5*a*.

As regards the sheet member 14, the sheet member 14 is made into such a degree of size as touches the bottom of developer container 5*a* when the second agitating means performs the agitating operation, whereby the action of feeding the toner 6 to the developing roller 8 side can be consolidated and further, the toner 6 on the bottom of the developer container 5*a* which could not heretofore be reached by the second agitating means 11 can be raked out as if it was swept by a broom, and this leads to the advantage that the toner 6 can be fully used up.

Also, the sheet member 14 of the second agitating means 11 is free to curve and therefore, even if it touches the bottom of the developer container 5*a*, the rotational torque of the second agitating means 11 does not greatly increase and further, it is not necessary to make the tolerance in the manufacture of the second agitating means 11 severe.

Figure 4:
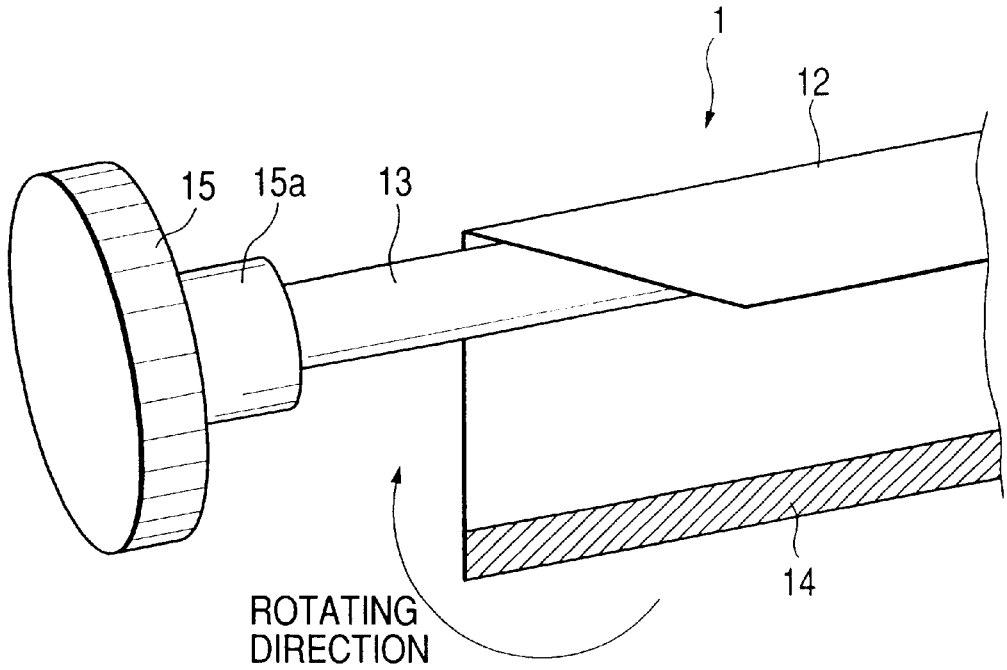
FIG. 4 is a perspective view showing a connecting portion to the drive system of the second agitating means.

The second agitating means 11, as shown in FIG. 4, has the shaft portion 15*a* of a gear 15 inserted onto the metal rod 13, whereby the force in the rotating direction is transmitted to the second agitating means 11.

In the present embodiment, the diameter of the support shaft 13 is 2.4 mm. The distance from the agitation center axis to the bottom of the developer container 5*a* is 5 mm. The thickness of the L-shaped metal plate 12 is 0.1 mm, the width thereof is 3.5 mm and the thickness of the sheet member 14 of PET is 50 $\mu$m, and the sheet member is made to protrude by 2.5 mm from the end portion of the SUS plate. That is, the sheet member 14 of the second agitating means 11 has such a degree of width as touches the bottom of the developer container 5*a*.

Also, the second agitating means 11 has a peripheral speed difference of 40% relative to the developing roller 8. The first agitating means 10 has a peripheral speed difference of 10% relative to the developing roller 8.

The toner 6 and a specific example in which the coat amount of the toner 6 on the developing roller 8 is a thin layer of 1.5 mg/cm$^2$ or less will now be described in detail.

First, as the toner 6, use is made of a negatively chargeable magnetic monocomponent toner. 100 parts by weight of styrene n-butyl acrylate copolymer, 80 parts by weight of magnetic material particles and 2 parts by weight of negatively charged control agent of monoazo iron complex as binding resin, and 3 parts by weight of low molecular weight polypropylene as wax were melted and kneaded by a two-axis extruder heated to 140° C., and the cooled kneaded material was roughly pulverized by a hammer mill, and the roughly pulverized material was finely pulverized by a jet mill, and the obtained finely pulverized material was air-classified to thereby obtain classified powder having a weight-average diameter of 5.0 $\mu$m. 1.0 part by weight of hydrophobic silica fine powder was mixed with the classified material having the average grain diameter of 5.0 $\mu$m by a henschel mixer to thereby obtain a developer. The index MI of fixativity is 20. As the toner 6 in the present embodiment, use can be made of one having MI 3 to 30 and a weight-average grain diameter within the range of 3.5 to 7.0 $\mu$m.

By thus making the weight-average grain diameter of the toner small, one-dot reproducibility becomes good and the quality of image is improved.

Also, in order to reduce the coat amount of the toner 6 on the developing roller 8, the following setting was done in the present embodiment.

The developing roller 8 is a non-magnetic aluminum sleeve having a diameter of 16 mm and having its surface coated with a resin layer containing electrically conductive particles and having surface roughness Ra=1.0 μm, and is rotated at a peripheral speed of 50 mm/s in the direction of arrow R2 in FIG. 1.

The developing blade 9 is disposed in the developing apparatus 5 so that silicone rubber of rubber hardness JISA 40° may bear on the developing roller 8 with a abutting force (bearing load gf/cm per/cm in the longitudinal direction of the developing roller 8) of 40 gf/cm ($40\times10^{-3}\times9.8\cong3.9\times10^{-2}$ N/cm). Also, the contact width (nip) between the developing roller 8 and the developing blade 9 is 1.0 mm, and the distance from the most upstream position of contact (the upstream position with respect to the rotating direction of the developing roller) to the free end of the developing blade 9 (hereinafter referred to as NE) is 2.0 mm.

A magnet roll 18 is fixedly disposed in the developing roller 8. This magnet roll 18 has four magnetic poles N1, S1, N2 and S2 of magnetic flux density 75 mT alternately disposed therein. The above-described monocomponent magnetic toner 6 is contained in the developing apparatus 5, is fed to the vicinity of the developing roller 8 by the first and second agitating means 10 and 11, and thereafter is supplied to the developing roller 8 by the action of a magnetic field formed by the magnet roll 18 and is carried with the rotation of the developing roller 8. Thereafter, the toner is subjected to triboelectrification and layer-thickness regulation, in the portion of contact with the developing blade 8, and is carried to a developing area. In the present embodiment, the amount of the toner on the developing roller 8 is 1.20 mg/cm$^2$.

An alternate voltage comprising an alternating current superimposed on a direct current is applied from a voltage source 7 to the developing roller 8 to thereby form a developing electric field between the photosensitive drum 1 and the developing roller 8, and the development of an electrostatic latent image is effected in accordance with the electric field. A developing bias comprising AC (AC voltage): rectangular wave Vpp=1600 V, f=2000 Hz superimposed on a DC voltage: Vdc=−500 V is applied to the developing roller 8. The developing roller 8 and the photosensitive drum 1 are opposed to each other with a gap of 300 μm kept at the most proximate position. The photosensitive drum 1 is uniformly charged to charging potential Vd=−700, and is exposed by a laser in accordance with an image signal and that portion becomes V1=−150 V. The V1 portion is reversal-developed by the negatively chargeable toner 6.

As regards the developing blade 9, stainless steel of a thickness 60 μm having a primer for silicone applied thereto was disposed in a pre-heated mold, and LTV silicone rubber (LSRSE6744: DOW CORNING TORAY SILICONE CO., LTD.) was extruded thereto by an LIM extrusion molding machine, was taken out of the mold at 150° C. five minutes after, was heat-treated at 200° C. for four hours and was integrally molded to thereby obtain a silicone rubber blade of rubber hardness 40°.

Also, as means for detecting that the amount of the toner in the developing apparatus 5 has become small, as shown in FIG. 1, an antenna rod 3 made of a metal is installed near the developing roller 8. The electrostatic latent image between the developing roller 8 and the antenna rod 3 is measured, and the electrostatic latent image, when the amount of the toner 6 between the developing roller 8 and the antenna rod 3 has become small, is detected to thereby display warning.

By the above-described construction, even a highly fine image of 1200 dpi or greater is developed more faithfully to the latent image than in the developing apparatus according to the prior art, and the scattering of characters becomes reduced and the density irregularity in a page becomes null.

Figure 5:
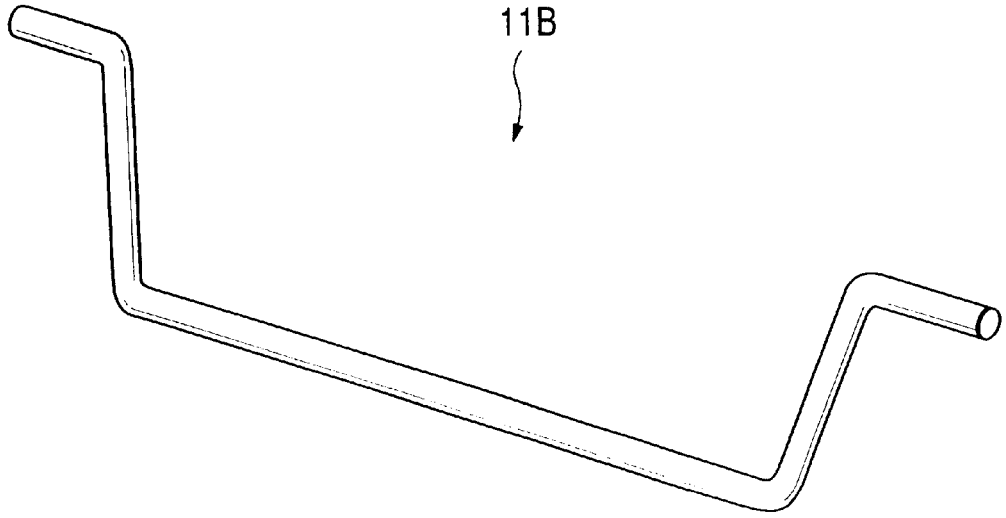
FIG. 5 is a perspective view showing rod-like agitating means according to the prior art.

In the construction as described above, with regard to a case where the second agitating means 11 is absent, a case where the second agitating means 11B is rod-like as shown in FIG. 5, and a case where the second agitating means 11 is of the construction as described above, the step of using an image forming apparatus of 8 ppm (A4 size longitudinal feeding) and supplying 2,000 sheets under high-temperature high-humidity environment and stopping the supply for 24 hours was repeated, and the manner of reduction in density up to 10,000 sheets was evaluated.

The evaluation of density was done by measuring each three points of the central portion and the opposite end portions in the longitudinal supply of A4 size, and the average reflection density at nine points in total and the difference between the maximum value and the minimum value of the average reflection density at three points of the central portion and the opposite end portions (uniformity) were confirmed. In the measurement of density, use was made of a Macbeth density meter RD-914 produced by Kollmorgen Instruments Corp.

Figure 6:
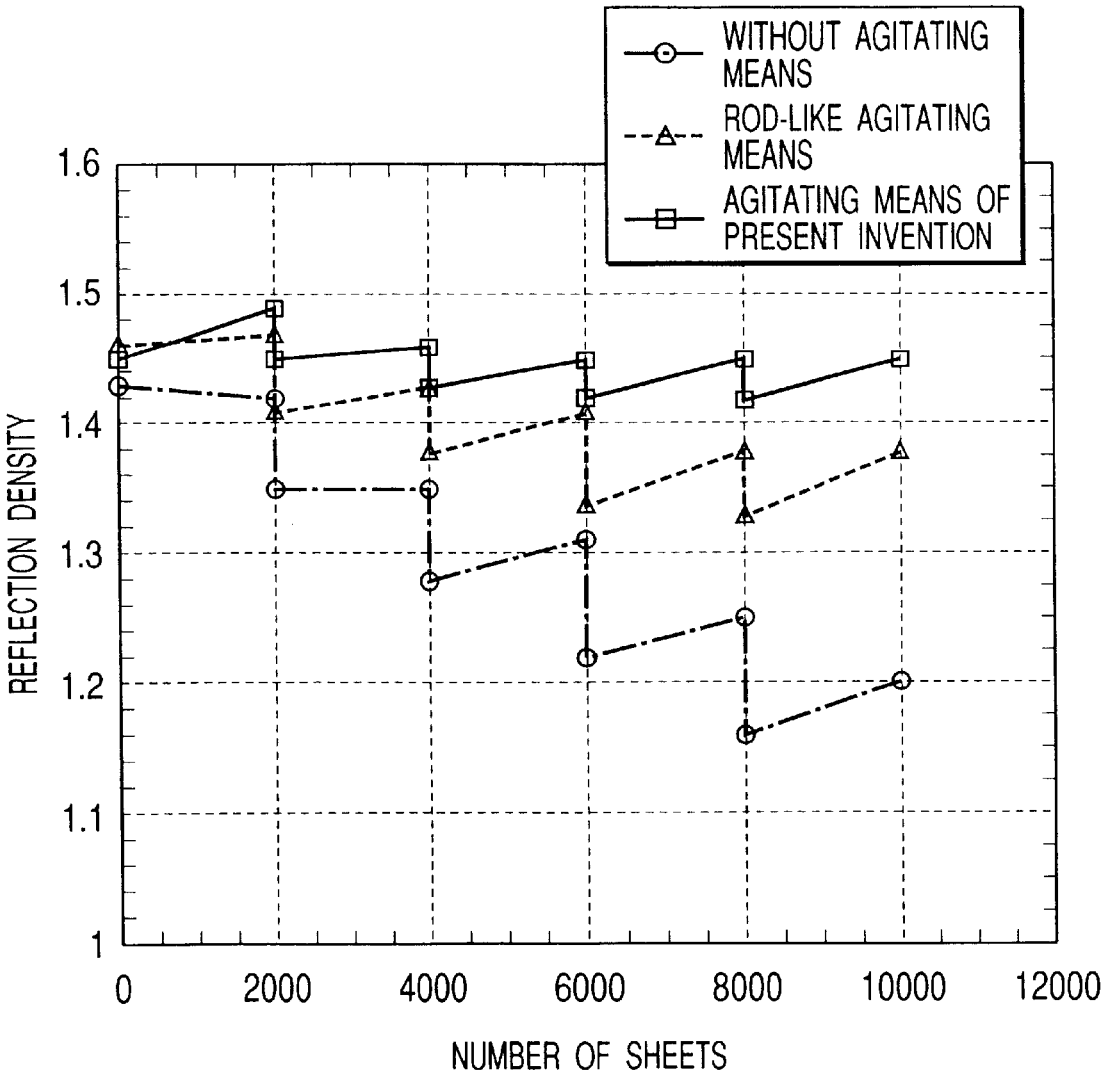
FIG. 6 is a graph showing the relations between reflection density (9-point average reflection density) and the number of printed sheets in a case where the agitating means is absent, the case of the rod-like agitating means and the case of the agitating means of the present invention.
Figure 7:
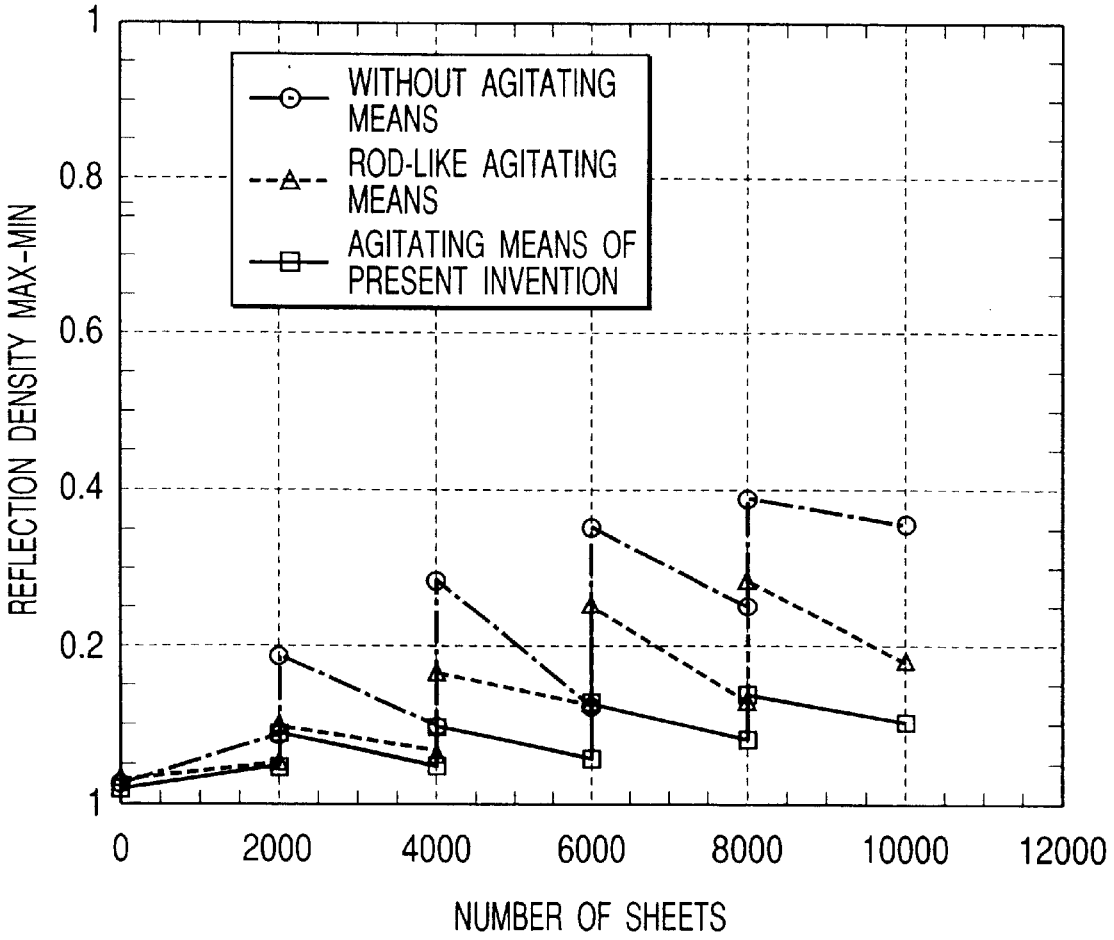
FIG. 7 is a graph showing the relations between reflection density (uniformity) and the number of printed sheets in a case where the agitating means is absent, the case of the rod-like agitating means and the case of the agitating means of the present invention.

The result of the average reflection density at nine points is shown in FIG. 6, and the result of uniformity is shown in FIG. 7.

First, when the second agitating means 11 was absent, the average reflection density at nine points was low over all the supplied sheets and a satisfactory quality of image was not obtained. The density is somewhat lower than in the rod-like second agitating means 11A and the agitating means according to the present embodiment. It was confirmed that in the uniformity of FIG. 7, the rod-like second agitating means 11A was great and the opposite end portions on the image were thin. In contrast, it was confirmed that the second agitating means 11 according to the present embodiment was low in uniformity and uniform density was obtained over an image area and the construction of the present invention was sufficiently effective.

Also, it was confirmed that the amount of the toner remaining in the developer container 5*a*, when the warning of the absence of the toner was shown on the display in the main body of the image forming apparatus, was 25 g in the case of the developing apparatus according to the prior art, whereas it was 20 g (a decrease) in the case of the construction of the present embodiment. In terms of the number of sheets, 100 more sheets could be printed in the case of A4 size (4% printing).

As described above, in the construction wherein the coat amount of the toner 6 on the developing roller 8 is 1.5 cm$^2$ or less, the vane member of the construction of the present invention is provided in the second agitating means 11 to thereby increase the agitation diameter and increase the agitating force for the toner 6, whereby the charge amount of the toner is stabilized and the scattering of the toner is suppressed and thus, a high quality of image is achieved, and the fluidity of the toner near the developing roller is increased to thereby better the circulation of the toner in the developer container and prevent the localized deterioration of the toner, and even under a high-temperature, high-humidity environment, a stable density is obtained and the toner 6 in the developing apparatus 5 can be more fully used up without waste.

[Second Embodiment]

A second embodiment is a further development of the agitating means 11 according to the first embodiment.

The shape of the metal rod 13, which is a support shaft, is made concave, and the adhesive securing thereof to the L-shaped metal plate 12 is effected in a plane and the fixing thereof is stabilized.

Also, in the first embodiment, as the construction for transmitting the drive from the gear 15 to the first agitating means 10, a portion of the end of the gear 15 is adapted to catch on the L-shaped metal plate 12 and therefore, it is necessary to select a material of such strength that the portion of the gear can stand the torque during driving. So, in the present embodiment, the construction of that portion that transmits the drive has been developed so that the gear can sufficiently stand the torque of driving.

Figure 8:
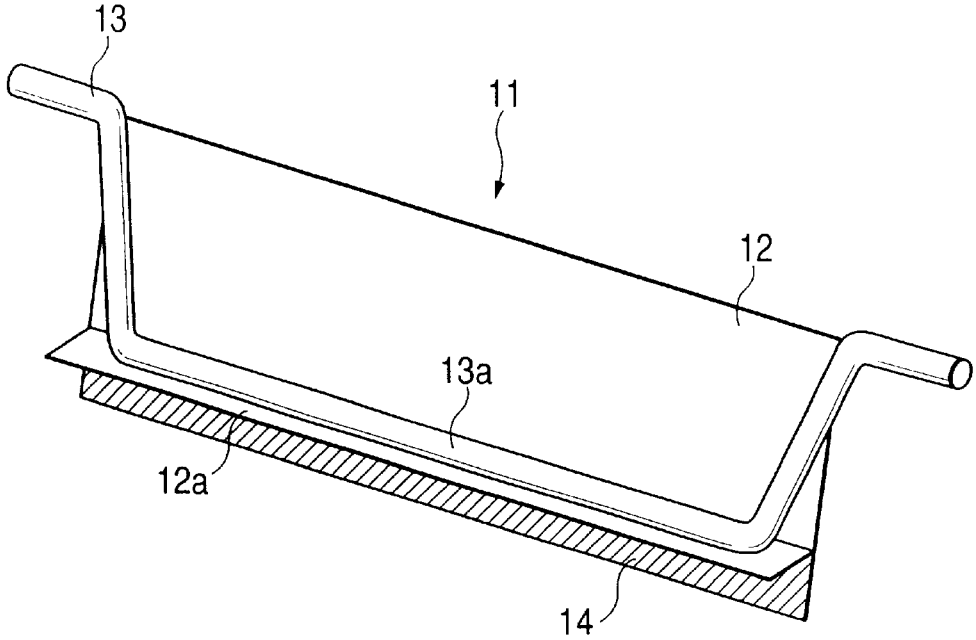
FIG. 8 is a perspective view showing agitating means according to a second embodiment of the present invention.

The agitating means 11 according to the present embodiment is shown in FIG. 8.

In the present embodiment, as shown in FIG. 8, the shape of a metal rod 13, which is a support shaft, is made concave within the developing width of the developing apparatus, and the L-shaped portion 12*a* of an L-shaped metal plate 12 of SUS is welded so as to strike against the concave portion 13*a*, and a sheet 14 of PET is stuck along the end portion of the metal plate 12 by an adhesive agent. Again, in the present embodiment, the L-shaped portion 12*a* is dashed against the concave portion 13*a* of the metal rod 13, whereby the stability of assembly can be improved, and the fixing becomes stable because the adhesive securing of the metal rod 13 and the L-shaped metal plate 12 is planar.

Figure 9:
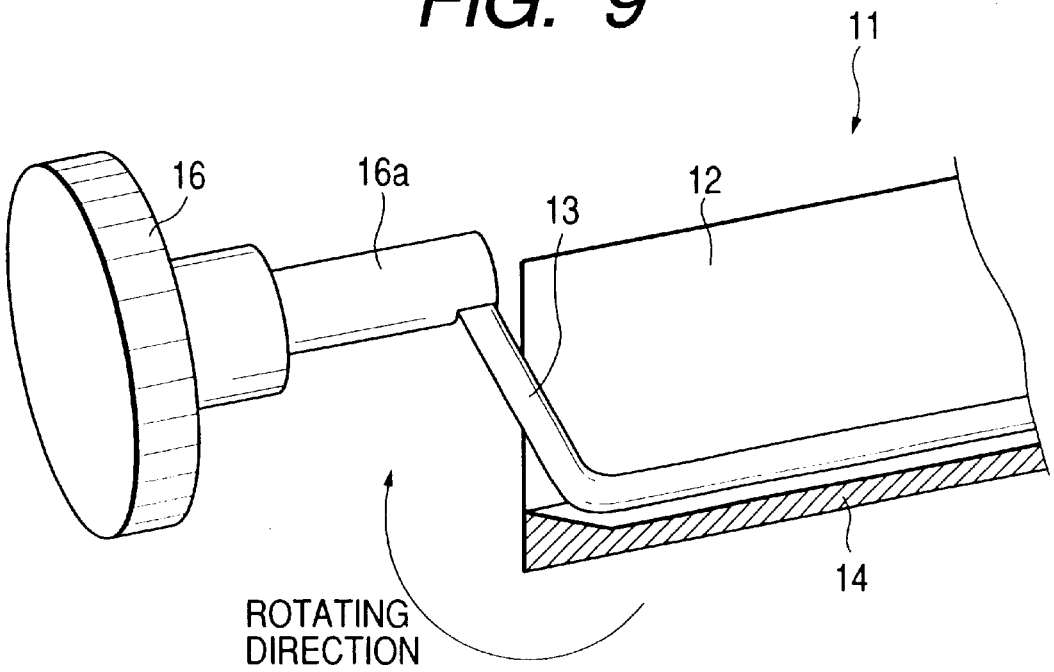
FIG. 9 is a perspective view showing a connecting portion to a driving system in the second embodiment.
Figure 10:
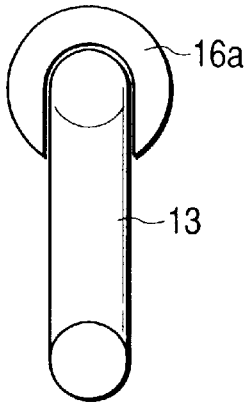
FIG. 10 is a side view showing the connecting portion in FIG. 9.

Also, as shown in FIG. 9, the coupling of the second agitating means 11 and a gear 16 is such that the shaft portion 16*a* of the gear 16 catches on the bent portion of the metal rod 13. FIG. 10 is a cross-sectional view showing the gear 16 and the metal rod 13 as they are coupled together.

The inserted portion of the metal rod 13 in the tip end portion of the shaft portion 16*a* of the gear 16 is of an elliptical shape, and the portion of the metal rod 13, which is the support shaft, and a bent portion thereof are held in the inserted portion in the shaft portion 16*a* of the gear 16. The end of the gear 16 is increased in strength because it is of a shape that holds the metal rod 13 so as to cover the latter, and it never happens that the gear 16 is damaged.

The developing apparatus according to the present embodiment was filled with 300 g of toner of a filling rate 0.65 g/ml ($0.65\times10^{-3}\times10^{-3}\times10^{-3}=0.65\times10^{-9}$ kg/m$^3$), and the developing device was driven for 30 minutes in a state in which tapping was effected for 10 minutes, but the gear 16 was not damaged.

Also, regarding the stability of density, as in the first embodiment, the low density after the apparatus was left as it was alleviated, whereafter the density rose, and stable density was obtained over the image area.

As described above, the shape of the metal rod 13 was made concave, and in the coupled portion thereof to the gear 16, the construction of the end portion of the inserted portion of the gear 16 was devised, whereby the fixing of the metal rod 13 and the L-shaped metal plate 12 became stable, and the strength of the gear 16 in agitation could be increased.

[Third Embodiment]

A third embodiment of the present invention will now be described with reference to FIG. 11. This embodiment is a process cartridge provided in the developing apparatus of the present invention.

Figure 11:
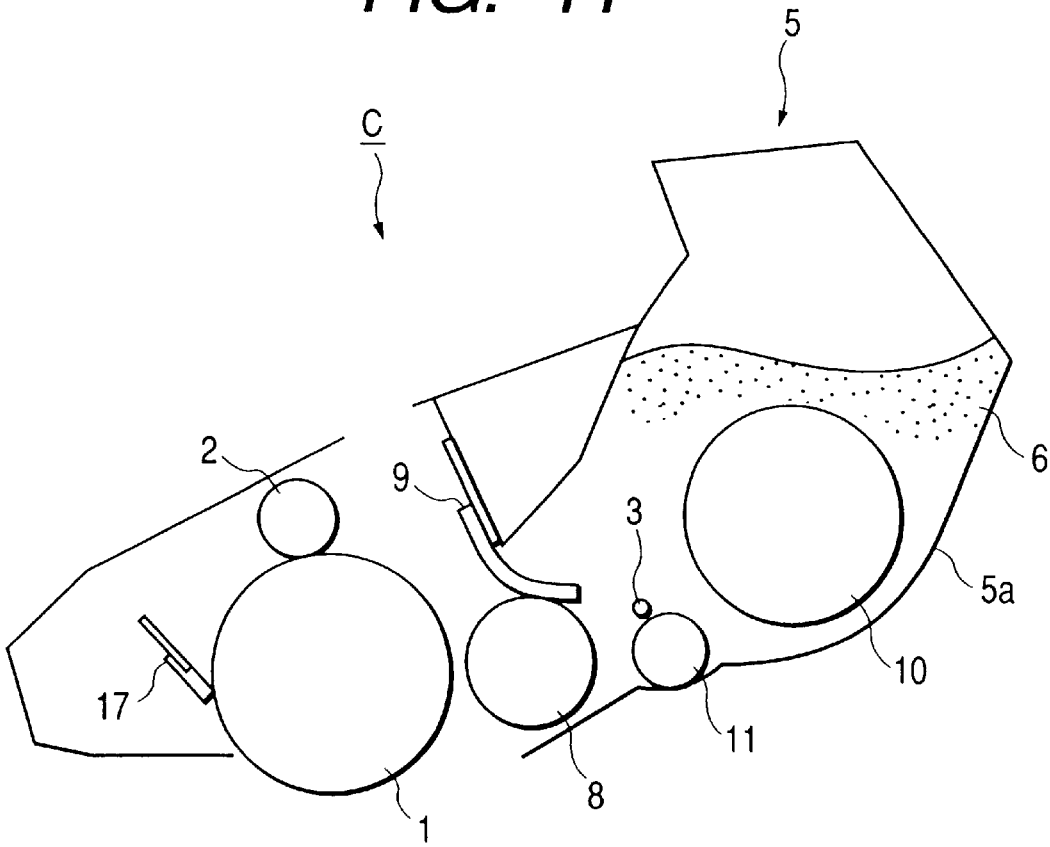
FIG. 11 shows the construction of a process cartridge in a third embodiment of the present invention.

In FIG. 11, the process cartridge C according to the present embodiment comprises a cylindrical photosensitive drum 1 which is an electrophotographic photosensitive member, a charging device 2 for charging the surface of the photosensitive drum 1, a developing apparatus 5 for visualizing a latent image on the surface of the photosensitive drum 1, and a cleaning device 17 for removing the toner 6 untransferred and remaining on the photosensitive drum 1 after transfer, these being made integral with one another, and is detachably attached to the main body of the image forming apparatus.

The process cartridge C according to the present embodiment is provided with the second agitating means 11 according to the second embodiment.

The process cartridge has become maintenance-free and easy to use, while on the other hand, the toner in it is only the toner initially contained in the developing apparatus 5 and there is no replenishment of the developing apparatus with fresh toner. Consequently, if during the use of the process cartridge, the circulation of the toner 6 is bad, the toner 6 becomes deteriorated early, and if the toner 6 in the developer container 5*a* is little, the deterioration of the toner is further promoted.

To suppress this deterioration, it is important to make the circulation of the toner 6 good from the early stage of the use of the process cartridge.

By the second agitating means 11 according to the present embodiment, even in the form of the process cartridge, the circulation of the toner 6 can be made smooth and the deterioration of the toner can be suppressed and therefore, under a high-temperature, high-humidity environment, the circulation of the toner 6 can be made smooth and the deterioration of the toner 6 can be suppressed and thus, the low density by the toner 6 cohering and packing under a high-temperature, high-humidity environment and the low density by the deterioration of the toner during the latter half of the use of the process cartridge can be prevented and stable images can be provided.

Figure 12:
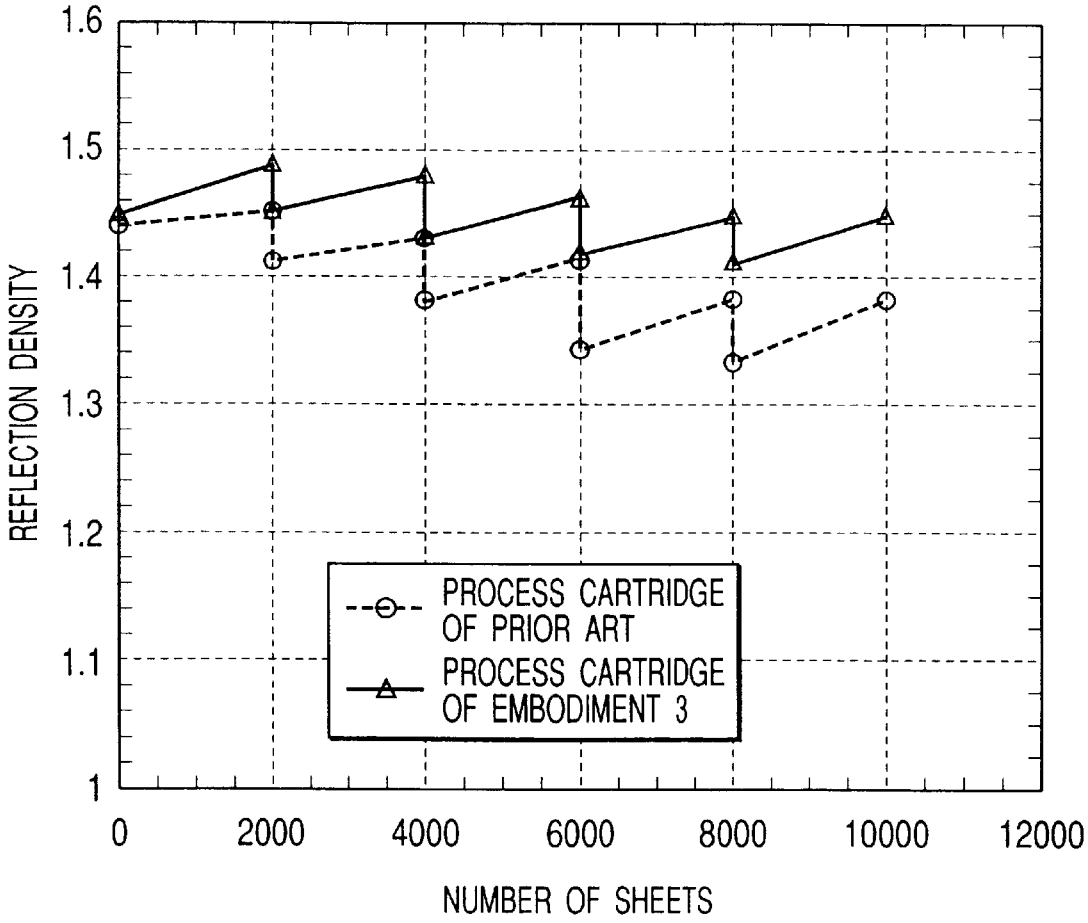
FIG. 12 is a graph showing the relation (density transition) between reflection density and the number of printed sheets in a process cartridge according to the prior art and the process cartridge according to the third embodiment.
Figure 13:
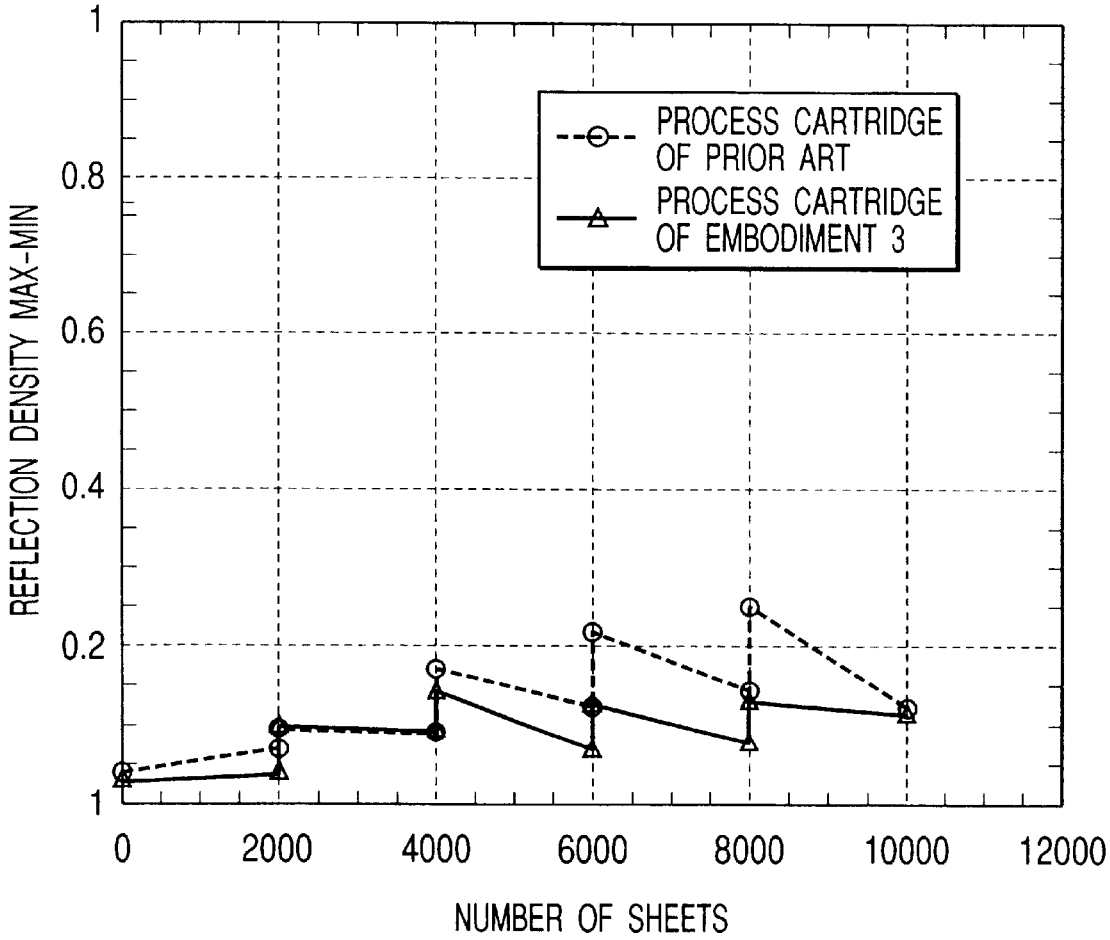
FIG. 13 is a graph showing the relation (uniformity) between reflection density and the number of printed sheets in the process cartridge according to the prior art and the process cartridge according to the third embodiment.

The transition and uniformity of density during the useful lives of the process cartridges according to the present embodiment and the prior art are shown in FIGS. 12 and 13, respectively.

Under an environment in which temperature was 32° C. and humidity was 83%, a print test was carried out up to 10,000 sheets by the utilization of an image forming apparatus of 8 ppm.

As shown in FIGS. 12 and 13, it was confirmed that in the present embodiment, the density was stable for about 6,000 sheets, which was the latter half of the life, and a great effect was obtained as compared with the example of the prior art.

As described above, the present invention is also applied to the process cartridge and can maintain a high quality of image and yet can prevent the low density by the cohesion of the toner and the low density by the deterioration of the toner, and can obtain stable density throughout the life of the process cartridge.

[Fourth Embodiment]

Figure 14:
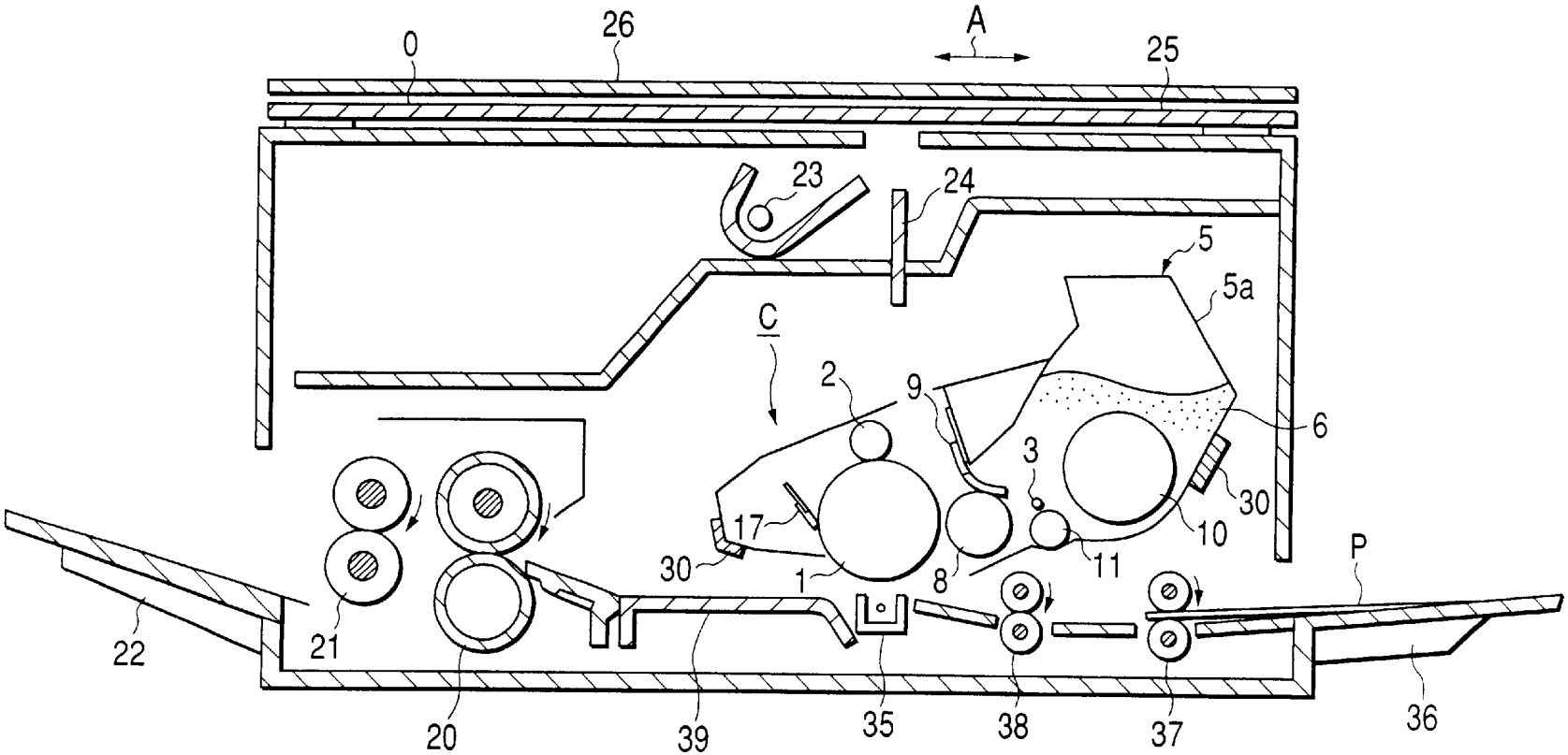
FIG. 14 shows the general construction of an electrophotographic image forming apparatus according to a fourth embodiment of the present invention.
Figure 15:
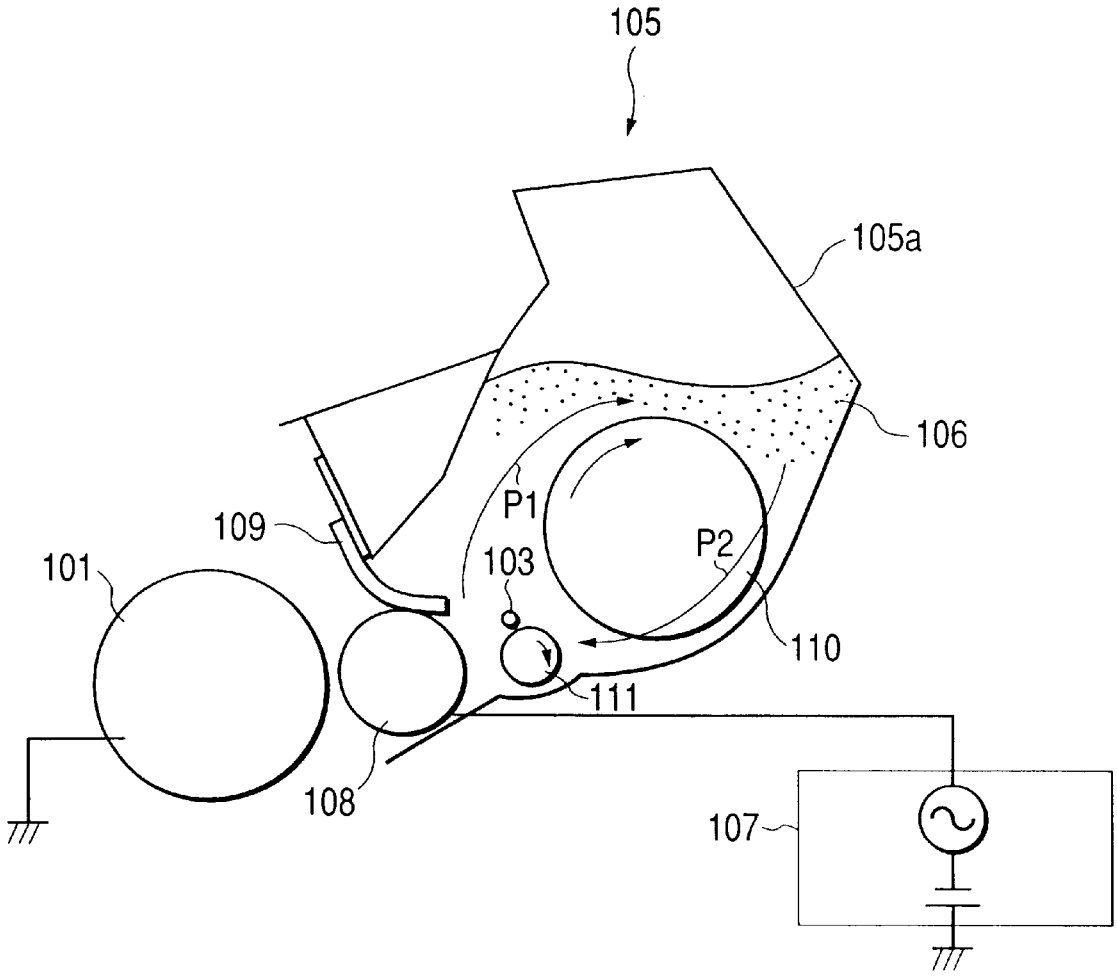
FIG. 15 shows the construction of an example of the developing apparatus according to the prior art.

A fourth embodiment of the present invention will now be described with reference to FIG. 14. This embodiment relates to an electrophotographic image forming apparatus (copier) to which the process cartridge in the third embodiment is attached.

In the present embodiment, the process cartridge C is detachably attachable to the main body of the image forming apparatus through mounting means 30.

Also, transfer charging means 35 is disposed in the lower portion of the main body of the image forming apparatus wherein the photosensitive drum 1 in the process cartridge C is located. Further, a sheet feeding tray 36, sheet feeding rollers 37 and registration rollers 38 are disposed on the sheet feeding side with respect to the transfer charging means 35, and on the other hand, a sheet guide 39, fixing means 20, sheet discharging rollers 21 and a sheet discharge tray 22 are disposed on the sheet discharging side.

Further, above the process cartridge C, there are disposed an illuminating lamp 23 for illuminating an original and a short-focus optical element array 24 for exposing the photosensitive drum 1 to the reflected image light of the light applied from the illuminating lamp 23 to the original 0. Also, an original supporting table 25, movable in the direction of arrow A, is provided on the upper portion of the main body of the image forming apparatus, and an original pressing plate 26 is attached to the original supporting table 25.

In the electrophotographic image forming apparatus of the above-described construction, when the reflected image light of the light applied from the illuminating lamp 23 to the original O is applied through the short-focus optical element array 24 onto the photosensitive drum 1 uniformly charged by the charging means 2, an electrostatic latent image conforming to the information of the original is formed on the photosensitive drum 1. The developing apparatus 5, as previously described, is provided with the developing roller 8 bearing and carrying the developer (toner) thereon. The latent image on the photosensitive drum 1 is made into a visible image, i.e., a toner image, by the toner being supplied from the developing roller 8.

On the other hand, a recording medium P such as a transfer sheet is sent to the registration rollers 38 through the sheet feeding tray 36 and the sheet feeding rollers 37 constituting conveying means, and is conveyed to between the photosensitive drum 1 and the transfer charging means 35 while being timed by the registration rollers 38. By the action of the transfer charging means 35, the toner image on the photosensitive drum 1 is transferred onto the transfer sheet P.

The transfer sheet P bearing the transferred toner image thereon is sent to the fixing means 20, whereby the toner image is fixed, whereafter the transfer sheet P is stacked on the sheet discharge tray 22 by the sheet discharging rollers 21.

After the transfer, the photosensitive drum has any residual toner thereon removed, for example, by an elastic cleaning blade 17, and is used for the next image forming process.

Again in the electrophotographic image forming apparatus as described above, an effect similar to the effect described above can be obtained by applying the above-described agitating means.

As is apparent from the foregoing description, the agitating means according to the present embodiment has the support shaft, the L-shaped metal plate and the free-to-curve sheet or film stuck on the L-shaped metal plate, whereby a sufficient agitating force is obtained even in a small space and the toner contained in the developer container can be utilized without waste as far as possible.

Also, according to the developing apparatus, the process cartridge and the electrophotographic image forming apparatus according to the present embodiment, on the developer bearing member, the amount of applied developer in the developing area after regulated by the developer regulating member is 1.5 mg/cm$^2$ or less, and the first and second agitating means for agitating and carrying the developer in the developer container are installed, and when the developing apparatus is mounted to the main body of the image forming apparatus, the agitation locus of the first agitating means disposed on the side far from the developer bearing member and the agitation locus of the second agitating means disposed on the side near to the developer bearing member overlap each other in the vertical direction, and the second agitating means has the support shaft, the L-shaped metal plate and the free-to-curve sheet or film stuck on the L-shaped metal plate, whereby the deterioration of the toner can be prevented and even under a high-temperature, high-humidity environment, the scattering of the toner is small and a highly fine quality of image is obtained, and uniform density is obtained in the image area and further, stable density is obtained throughout the life of the toner.

What is claimed is:

1. A developing apparatus comprising:

a developer container containing the developer therein;

a developer bearing member provided at an opening portion of said developer container, for bearing the developer thereon;

a first agitating member for agitating the developer in said developer container while carrying the developer to said developer bearing member side; and a second agitating member provided between said developer bearing member and said first agitating member, for agitating and carrying the developer;

wherein said second agitating member has an agitating diameter smaller than that of said first agitating member and includes a metal shaft, a metal plate joined to the metal shaft, and an elastic sheet provided on the metal plate.

2. A developing apparatus according to claim 1, wherein said metal shaft is a straight rod.

3. A developing apparatus according to claim 1, wherein said metal shaft is an axially concave rod.

4. A developing apparatus according to claim 1, wherein said metal plate member is L-shaped.

5. A developing apparatus according to claim 1, wherein an end of said metal plate cannot contact an end of said developer container, and the end of said elastic sheet can contact a bottom portion of said developer container.

6. A developing apparatus according to claim 1, wherein an agitation center of said first agitating member lies above an agitation center of said second agitating member.

7. A developing apparatus according to claim 6, wherein the diameter of the agitation locus of said first agitating member is 30 mm to 50 mm.

8. A developing apparatus according to claim 7, wherein a peripheral speed of said second agitating member and a peripheral speed of said first agitating member have differences relative to said developer bearing member, and the peripheral speeds of said second agitating member and said first agitating member differ from each other.

9. A developing apparatus according to claim 1, wherein the developer is a monocomponent developer and the weight average grain diameter is 7 $\mu$m or less.

10. A developing apparatus according to claim 1, wherein said first agitating member is provided at a location farther from said developer bearing member than said second agitating member, and wherein said apparatus further comprises a developer regulating member for regulating the developer borne on said developer bearing member, wherein an amount of applied developer regulated by said developer regulating member is 1.5 mg/cm$^2$ or less.

11. A developing apparatus according to claim 1, wherein a bias voltage comprising an AC voltage superimposed on a DC voltage is applied to said developer bearing member.

12. A developing apparatus according to claim 1, which is detachably attachable to a main body of an image forming apparatus.

13. A developing apparatus comprising:

a developer bearing member bearing a developer thereon;

a developer container containing the developer therein, said developer being a monocomponent developer of which a weight average grain diameter is 7 $\mu$m or less; and an agitating member provided in said developer container for agitating the developer while supplying the developer to said developer bearing member, said agitating member including:

a straight metal shaft;

an L-shaped metallic plate member joined to said metal shaft, an end of said plate member being incapable of contacting an end of said developer container;

a sheet member joined to said plate member, said sheet member being free to curve, and an end of said sheet member being capable of contacting with a bottom portion of said developer container;

another agitating member, agitation loci of said agitating member and said another agitating member overlapping each other in a vertical direction, a diameter of the agitation locus of said another agitating member being larger than a diameter of the agitation locus of said agitating member, an agitation center of said another agitating member lying above an agitation center of said agitating member, the diameter of the agitation locus of said another agitating member being 30 mm to 50 mm, a peripheral speed of said another agitating member and a peripheral speed of said agitating member having differences relative to said developer bearing member, the peripheral speeds of said another agitating member and said agitating member differing from each other; and a developer regulating member for regulating the developer borne on said developer bearing member, an amount of applied developer regulated by said developer regulating member being 1.5 mg/cm$^2$ or less.

14. A process cartridge detachably attachable to a main body of an image forming apparatus, comprising:

an electrophotographic photosensitive member; and a developing apparatus including:

a developer container containing the developer therein;

a developer bearing member provided at an opening portion of said developer container, for bearing the developer thereon;

a first agitating member for agitating the developer in said developer container while carrying the developer to said developer bearing member side; and a second agitating member provided between said developer bearing member and said first agitating member, for agitating and carrying the developer;

wherein said second agitating member has an agitating diameter smaller than that of said first agitating member and includes a metal shaft, a metal plate joined to the metal shaft, and an elastic sheet provided on the metal plate.

* * * * *

UNITED STATES PATENT AND TRADEMARK OFFICE

CERTIFICATE OF CORRECTION

PATENT NO. : 6,337,964 B2
DATED : January 8, 2002
INVENTOR(S) : Satoru Inami et al.

It is certified that error appears in the above-identified patent and that said Letters Patent is hereby corrected as shown below:

Column 12,
Line 14, “developer ;” should read -- developer, --.
Line 25, “member” should be deleted.

Column 14,
Line 17, “developer ;” should read -- developer, --.

Signed and Sealed this

Fourth Day of February, 2003

JAMES E. ROGAN
*Director of the United States Patent and Trademark Office*